US005253870A

United States Patent [19]

Bedney

[11] Patent Number: 5,253,870

[45] Date of Patent: Oct. 19, 1993

[54] GOLF PRACTICING DEVICE WITH HEAD MOTION DETECTOR

[76] Inventor: Reginald C. Bedney, 663 S. Indian Hill Blvd., Claremont, Calif. 91711

[21] Appl. No.: 858,311

[22] Filed: Mar. 25, 1992

[51] Int. Cl.[5] ..... A63B 69/36

[52] U.S. Cl. ..... 273/187.2; 273/DIG. 17; 273/190 A

[58] Field of Search ..... 273/187.2, 190 A, DIG. 30, 273/DIG. 17, 187.6

[56] References Cited

U.S. PATENT DOCUMENTS

| | | | |
|---|---|---|---|
| 1,169,188 | 1/1916 | Peck | 273/183 B |
| 1,459,705 | 6/1923 | Bullock | 273/190 A |
| 1,753,309 | 4/1930 | Costello | 273/DIG. 17 |
| 3,109,654 | 11/1963 | Comitz | 273/183 B |
| 3,156,211 | 11/1964 | Mallory | 273/183 B |
| 3,178,187 | 4/1965 | Cardwell | 273/183 B |
| 3,264,002 | 8/1966 | Palumbo | 273/183 B |
| 3,437,339 | 4/1969 | Starck | 273/183 B |
| 3,542,364 | 11/1970 | Gaumond | 273/DIG. 30 |
| 3,670,417 | 6/1972 | Rogers | 273/187.2 |
| 3,951,414 | 4/1976 | Nunez | 273/183 B |
| 4,079,940 | 3/1978 | Arakaki | 273/183 B |
| 4,298,201 | 11/1981 | Palinkas | 273/183 B |
| 4,519,608 | 5/1985 | Gilly | 273/183 B X |
| 4,789,159 | 12/1988 | Kane | 273/183 B |

*Primary Examiner*—George J. Marlo

*Attorney, Agent, or Firm*—Poms, Smith, Lande & Rose

[57] ABSTRACT

A golf practicing device having a head motion detector. The device includes a hand band mounted to the golfer's head with a rigid elongated rod extending from the hand band. A rigid view bar detector extends normal to the terminal end of the rod and downwardly a short distance therefrom thereby providing one end that is visible to the golfer to indicate motion of the golfer's head when swinging.

8 Claims, 1 Drawing Sheet

Fig. 1.
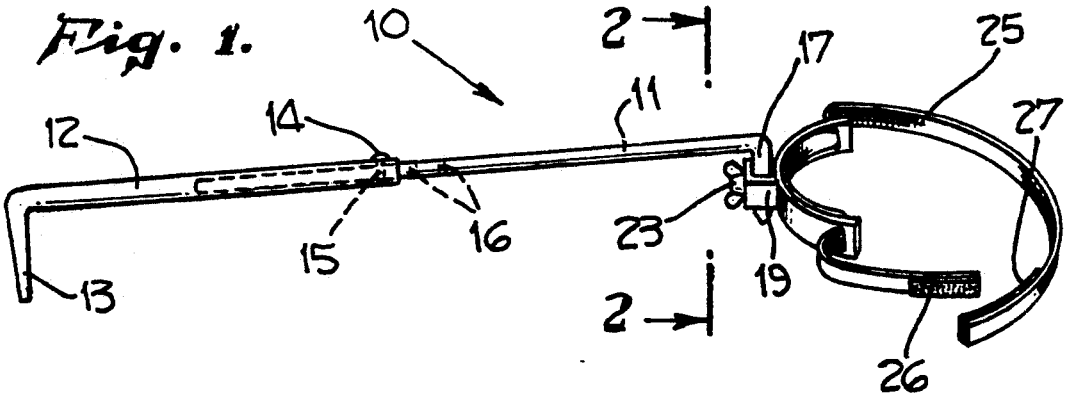
Fig. 2.
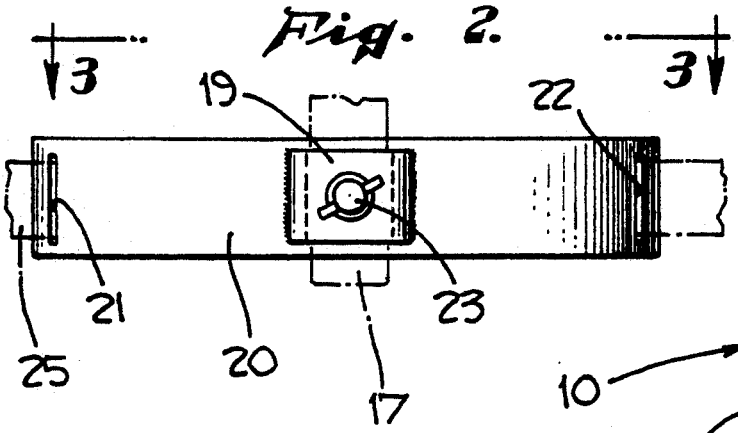
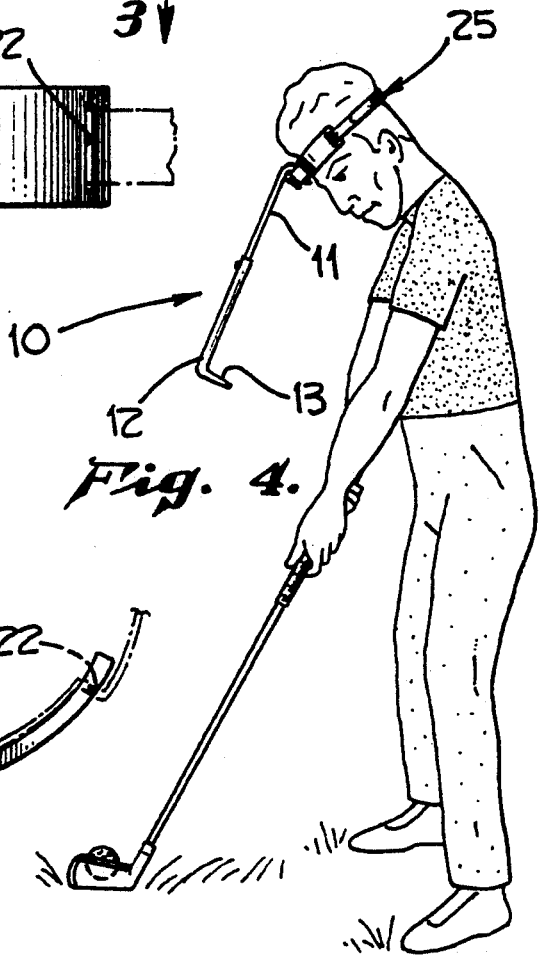
Fig. 4.
Fig. 3.
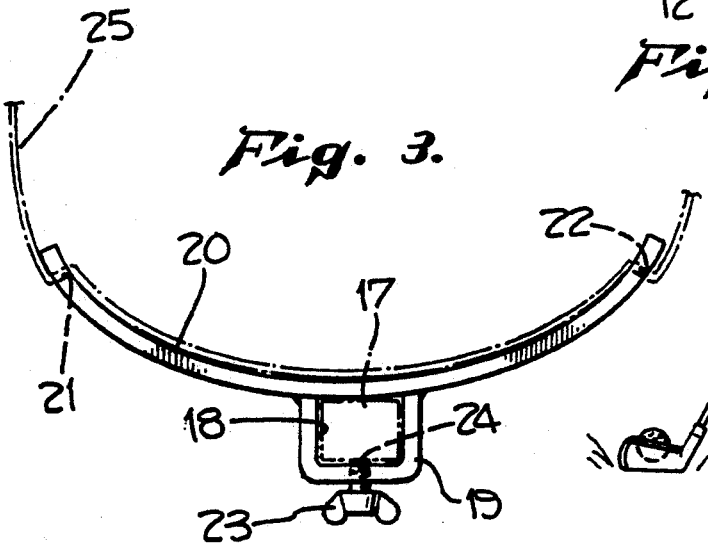
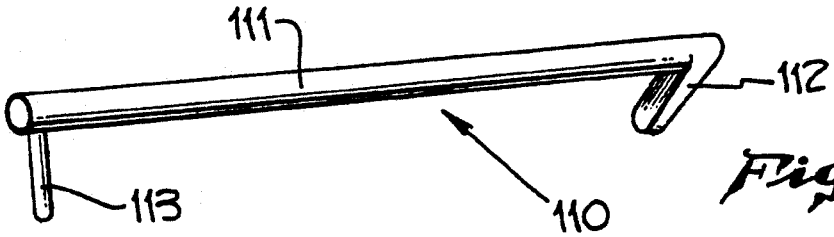
Fig. 5.

GOLF PRACTICING DEVICE WITH HEAD MOTION DETECTOR

BACKGROUND OF THE INVENTION

1. Field of The Invention

The invention relates to a golf practicing device; and, more particularly, to a device which enables the golfer to monitor his or her head movement when swinging.

2. Description of The Prior Art

Many ideas have come forth over the years for instructing one in the proper method of playing the game of golf. Some of the prior devices proposed over the years are described in the following patents: U.S. Pat. No. 4,079,940; U.S. Pat. No. 4,789,159; U.S. Pat. No. 4,298,201; and U.S. Pat. No. 1,169,188. These patents are directed to the concept of enabling the golfer to maintain a level head when swinging at the golf ball.

However, recent theories in determining proper golf swing indicate that some head motion is desirable for a smooth tension free golf swing. The correct minimum motion may be learned and flexibility and strength may be developed. The spine angle necessary for proper shoulder turn is a learned skill. Both proper head motion and spine angle may be accomplished by positioning the golfer's chin at an angle which will accommodate a full shoulder turn and maintain balance.

There is thus a need for a golf training device to assist a golfer in developing skills necessary for detecting proper head motion.

SUMMARY OF THE INVENTION

It is an object of this invention to provide a golf training device that enables a golfer to detect head motion during swing.

It is a further object of this invention to provide a golf training device worn on the head of a golfer that enables the golfer to establish proper spine angle and shoulder turn.

These and other objects are preferably accomplished by providing a golf practicing device having a head motion detector. The device is mounted to the golfer's head and has an elongated portion with a view bar detector at one end visible to the golfer to indicate motion of the golfer's head when swinging.

BRIEF DESCRIPTION OF THE DRAWING

FIG. 1 is perspective view of a head motion detector in accordance with the teachings of the invention;

FIGS. 2 and 3 are views taken along lines 2—2, and 3—3, respectively, of FIG. 1;

FIG. 4 is an elevational view of a golfer using the detector of FIGS. 1 to 3; and FIG. 5 is a modification of a portion of the detector of FIGS. 1 to 4.

DESCRIPTION OF THE PREFERRED EMBODIMENT

Referring now to FIG. 1 of the drawing, a head motion detector 10 is shown comprised of a first elongated tubular member 11 telescopingly mounted inside of a second elongated tubular member 12 having an extension portion 13 extending generally normal to member 12 (member 12 and portion 13 thus forming an L-shaped member). Members 11, 12 may be square in cross-section, if desired.

A set screw 14 may be provided threaded into aligned threaded apertures 15, 16 in members 12, 11, respectively. That is, a plurality of threaded apertures 16 may be provided in tubular member 11 for varying the overall combined length of members 11, 12. Of course, apertures 16 may be eliminated, if desired, with set screw 14 merely abutting against the exterior of member 11 to hold members 11, 12 in a fixed telescoped position.

Member 11 also terminates at one end in a short extension portion 17, which may also be square shaped in cross section, extending generally normal to the main body portion of member 11.

As seen in FIGS. 2 and 3, extension portion 17 slides into an opening 18 (FIG. 3) in bracket 19 integral with an elongated generally rectangular planar band 20. Band 20 is provided with open slots 21, 22 at each end. Band 20 is also slightly arcuate (and may be of plastic or the like for conforming to the head of the golfer).

Bracket 19 is located at generally the middle of band 20 and a set screw 23 is threaded into threaded hole 24 in bracket 19 and extends into the interior of opening 18. As seen in FIGS. 1 to 3, extension portion 17 extends through opening 18 in bracket 19 and is securely held therein by set screw 23.

Referring again to FIG. 1, an elongated strap 25 of flexible material, such as leather or plastic, is threaded through slots 21, 22 (see particularly FIG. 3) and terminates at its free ends in mating patches 26, 27 of conventional hook and loop material such as Velcro material. In this manner, detector 10 can be quickly and easily attached to the head of a golfer, as seen in FIG. 4, with mating patches 26, 27 allowing easy adjustability of the strap 25.

Any suitable materials or dimensions may be used. For example, members 11, 12 may be of plastic with band 20 and integral bracket 19 being of a metallic or plastic material. Member 11 may be about 15" in overall length with extension portion 17 about 1½" in overall length. Member 12 is about 12" in overall length (up to extension portion 13) with extension portion 13 being about 4 inches in overall length. Band 20 may be about 8" in overall length.

In operation, detector 10 is mounted to the golfer's head as shown in FIG. 4. The following is accomplished:

1. SPINE ANGLE

Extension portion 13, in the line of sight of the golfer, acts as a view bar. It is of course removable from member 11 by unthreading set screw 14. The members 11, 12 make an angle of about 45° (using a line coincident with the longitudinal axis thereof) with the ground 28. This angle acts in raising the golfer's head. However, since golfers obviously vary in height, the angularity and length of the view bar or extension portion 13 allows for some variation of pitch for individual adjustment. Since detector 10 is attached to the golfer's head, the golfer is forced to raise his or her chin to point the extension portion 13 at the target ball (i.e., the golf ball on the ground, the longitudinal axis of extension portion 13 being aligned with the center of the golf ball). If done properly, the correct spine angle of the golfer is attained.

2. HIT CENTER

If one considers the golfer's swing to define in effect a wheel, the golfer's shoulders become the spokes of the wheel and the arms and hands of the golfer become the outer tread; the hub of the wheel would then be the golfer's neck. Because the neck can move independently and of course moves the golfer's head, we need to establish an area as a reference point that can be used as a pivotal point. This area is located at the base of the neck at the junction of the spine. This area is known as the hub or "Hit Center." The detector 10 can be used to stabilize this area at the moment of impact where it originally was at address of the ball in relationship to the position of the ball.

3. SHOULDER SWING

By establishing the correct spine angle (with the golfer's chin up), we can eliminate any interference that can be caused by the chin and allow the left shoulder to move to a position under the chin on the back swing and the right shoulder on the down or forward swing.

4. BALANCE

Raising the golfer's chin also aids in balance. When the golfer's head is down (chin resting on chest) the head becomes heavy and forces the weight out over the toes. When swinging from this position, one tends to lose one's balance. Holding the head up (chin raised) lightens the head and keeps the weight over the balls of the feet and back toward the heels. This gives balance to the body and a strong foundation for the power swing.

5. HEAD MOTION

Holding the head rigidly still, fixed and level over the ball while attempting to make the full swing causes tension and tension should be avoided at all cost. Any tension in the neck and shoulder area restricts the amount of turn one can generate and therefore limits the power and spoils rhythm and timing. Some movement of the head is expected. However, this movement must be kept to a minimum; no more than is required to make a smooth swing. A slight tilt of the chin to the right at address of the ball will facilitate a full shoulder turn. Holding the head in this position (which can be monitored for consistency with detector 10) until after the moment of impact and then, while maintaining the established spine angle, allow the head to swivel with a sweeping motion toward the target, results in the correct head motion.

It is imperative that all tension be kept out of the swing. Equally important is the position of the head at the moment of impact. This is most critical. Keeping the head in a steady position over the ball will insure the keeping the "Hit Center" at the point of address of the ball which is necessary for control of direction of all golf shots, whether long or short.

6. FOCUSING ON THE TARGET BALL

The length of the detector 10's extension portion or view bar 13 is designed specifically to accommodate the eyes so as to allow the golfer to observe the extension portion or view bar 13 while performing the swing (with or without a club). Some movement of the extension portion or view bar 13 is tolerable. The more skilled one becomes, the less movement one will observe. (Because the detector 10 is directly attached to the golfer's head and employs an extension portion 13, slight movements of the head are exaggerated.) The main objective is to make the right movements, be consistent but be sure the extension portion or view bar 13 does not pass the ball before impact.

When focusing on the ball while using the detector 10, one sees not one bar but two. If the operator's dominant eye is his or her left eye, pointing the extension portion or view bar at the back of the ball will frame the ball in between the two bars. If the dominant eye happens to be the right eye, it becomes necessary to place the extension portion or view bar 13 in front of the ball in order to frame it. The object is to keep the ball framed while making the swing.

Although detector 10 provides for a telescoping member 11, 12, as seen in FIG. 5, such member may be one piece, such as rod or member 110. Thus, member. 110 has a main elongated rigid bar 111 with an extension portion 112 at one end (portion 112 being similar to portion 17 of FIGS. 1 to 3 and also extending generally normal to bar 111) and a view bar 113 at the other end (bar 113 being otherwise similar to extension portion 113 of FIGS. 1 to 3). Member 110 and extension portion 112 may be square shaped in cross section. The member 110 is mounted to bracket 19 (FIGS. 1 to 3) in the same manner as heretofore discussed. Thus, member 110 may be used where telescoping sections are not necessary.

There is thus disclosed a unique detector for detecting the motion of a golfer's head during swing. The invention herein will assist the golfer in developing skills that will enable him or her to approach any golf shot with confidence.

The game of golf is a complicated sport. The demands of hitting a ball from tee to green and then holding out on the green presents a real challenge.

There are several facets of the game that can spoil a golf shot: alignment, grip, ball position and excessive movement. The most frustrating is the latter. If the golfer has a perfect stance, perfect alignment, perfect ball position and perfect grip but he or she moves the Hit Center, the shot goes astray. It takes practice to develop the skills required to accomplish this task. The detector of this invention was developed for this purpose.

Every component of the detector 10 has a purpose. The head bracket 19, 20 attaches intimately to the head so that any and all movements are apparent and yet the overall light weight is not a hindrance nor an interference to the swing.

The length of members 11, 12 is designed so the golfer can focus comfortably on the end of it while making the practice swing. There is nothing to reset before attempting a repeat swing.

The view bar or extension portion 13 at the end of the member 12 serves at least four purposes:

1. Head alignment (tilting head laterally).
2. Head position (hit center) in relationship to the ball at address.
3. Chin adjustment (flexion or extension), and
4. A point of release when the club head passes that spot (not to precede the moment of contact).

Holding the head steady in the address position until after impact is the hardest thing to do. The average golfer looks up well before the club head makes contact with the ball. This is caused by attempting to hit the ball. The operative word is H I T!! This invention, when used properly and frequently, encourages the golfer to SWING and let the ball get in the way.

Although a particular embodiment of the invention has been disclosed, other means for carrying out the teachings of the invention may occur to an artisan and the scope of the invention is to be determined only by the scope of the claims.

I claim:

1. A golf training device for detecting motion of the head of the golfer standing on a horizontal surface during a golf club swing comprising:

a generally rigid elongated member having an elongated extension portion rigidly mounted at one end of said member extending in a direction generally normal to the longitudinal axis of said member and a short distance therefrom, the longitudinal axis of said extension portion and said elongated member lying in the same plane;

an elongated band having means thereon receiving one end of said member therein whereby the longitudinal axis of said member extends outwardly away from said band with the longitudinal axis of said member making an angle of about 45° with said horizontal surface when mounted on the head of a golfer standing on said horizontal surface and said extension portion extends downwardly therefrom; and a flexible adjustable strap mounted to said band for encircling the head of a golfer having mating detachable means at opposite ends of said strap for detachably and adjustably mounting said strap to the head of a golfer whereby, when said band and strap encircle the head of a golfer, said band and strap form a circular plane, the longitudinal axis of said member being generally aligned with said circular plane, said rigid extension portion moves in unison with said member whereby, when said device is worn by said golfer, said extension portion is visible to said golfer to allow the golfer to view the same when swinging a golf club to thereby detect movement or non-movement of said extension portion during swinging of a golf club.

2. In the device of claim 1 wherein said band is slightly arcuate in cross-section for conforming to the forehead of a golfer.

3. In the device of claim 2 wherein said band has a slot at each end thereof receiving said strap therethrough.

4. In the device of claim 1 wherein said mating detachable means comprises mating patches of hook and loop material.

5. In the device of claim 1 wherein the overall length of said extension portion is 4".

6. In the device of claim 1 wherein said elongated member is comprised of a pair of telescoping sections, said sections including cooperating means thereon for fixedly adjusting one of said sections with respect to the other to thereby form said rigid elongated member, said extension portion being mounted to one end of one of said sections, the other of said sections being connected to said band.

7. In the device of claim 6 wherein the overall adjustable length of said first and second sections is between 12" to 27".

8. In the device of claim 7 wherein the overall length of said band is 8".

* * * * *